US006458241B1

(12) United States Patent
Doelle et al.

(10) Patent No.: US 6,458,241 B1
(45) Date of Patent: Oct. 1, 2002

(54) APPARATUS FOR CHEMICALLY LOADING FIBERS IN A FIBER SUSPENSION

(75) Inventors: Klaus Doelle, Appleton; Oliver Heise, Menasha, both of WI (US)

(73) Assignee: Voith Paper, Inc., Appleton, WI (US)

( * ) Notice: Subject to any disclaimer, the term of this patent is extended or adjusted under 35 U.S.C. 154(b) by 0 days.

(21) Appl. No.: 09/756,510

(22) Filed: Jan. 8, 2001

(51) Int. Cl.[7] ..... D21H 17/64
(52) U.S. Cl. ..... 162/9; 162/181.2
(58) Field of Search ..... 162/9, 10, 17, 162/18, 19, 23, 24, 25, 26, 70, 158, 145, 181.1, 181.2, 181.4, 182, 185, 90; 106/204.01; 241/18, 28, 47

(56) References Cited

U.S. PATENT DOCUMENTS 4,510,020 A * 4/1985 Green et al. ..... 162/169
5,122,230 A * 6/1992 Nakajima ..... 162/157.1
5,223,090 A 6/1993 Klungness et al. ..... 162/9
5,275,699 A * 1/1994 Allan et al. ..... 162/181.2
RE35,460 E * 2/1997 Klungness et al. ..... 162/9
5,679,220 A * 10/1997 Matthew et al. ..... 162/181.4
5,928,470 A * 7/1999 Shannon ..... 162/9
6,235,150 B1 * 5/2001 Middleton et al. ..... 162/9

* cited by examiner

*Primary Examiner*—Peter Chin
*Assistant Examiner*—Eric Hug
(74) *Attorney, Agent, or Firm*—Taylor & Aust, P.C.

(57) ABSTRACT

An apparatus for loading fibers in a fiber suspension with calcium carbonate includes a housing with a fiber source inlet, and inlet chamber and an accept outlet. A stator is carried by the housing. A rotor is positioned in opposing relation with the stator. Each of the rotor and the stator are positioned downstream from the inlet chamber. A reactant gas supply is positioned in fluid communication with the inlet chamber.

12 Claims, 1 Drawing Sheet

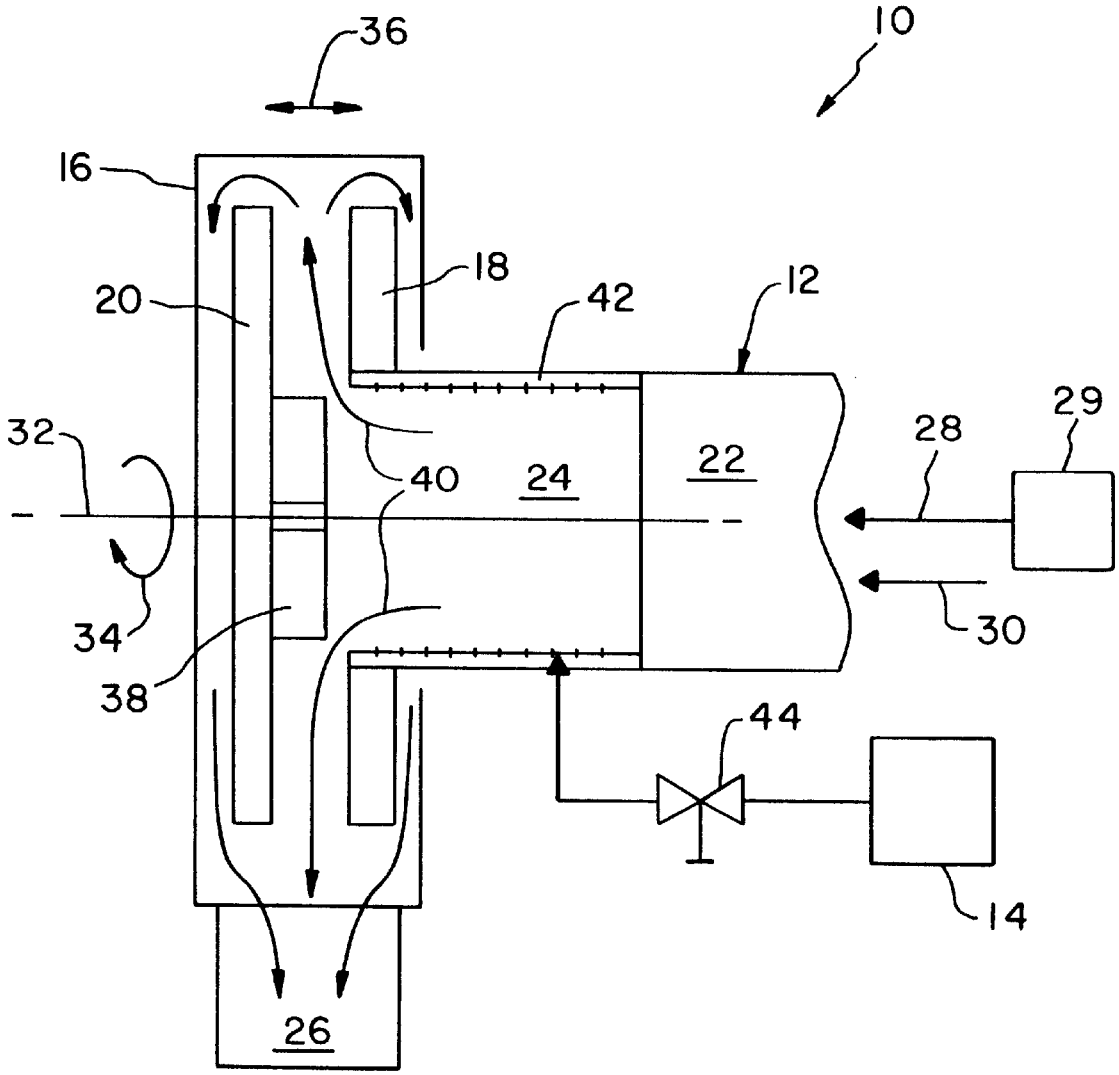
36
10
16
18
20
42
12
32
40
24
22
28
29
34
30
38
44
14
26

APPARATUS FOR CHEMICALLY LOADING FIBERS IN A FIBER SUSPENSION

BACKGROUND OF THE INVENTION

1. Field of the Invention

The present invention relates to an apparatus for loading fibers in a fiber suspension for use in a paper-making machine with a chemical compound, and, more particularly, to an apparatus for loading fibers in a fiber suspension with calcium carbonate.

2. Description of the Related Art

A paper-making machine receives a fiber suspension including a plurality of fibers, such as wood fibers, which are suspended within an aqueous solution. The water is drained from the fiber suspension and dried in the paper-making machine to increase the fiber content and thereby produce a fiber web as an end product.

The fiber web produced by the paper-making machine typically includes organic wood fibers and inorganic fillers. A known inorganic filler is calcium carbonate, which may be added directly to the fiber suspension (direct loaded calcium carbonate). It is also known to chemically load the fibers within a fiber suspension with calcium carbonate in the lumen and walls of the individual fibers (fiber loaded calcium carbonate). The fiber loaded calcium carbonate increases the strength of the paper compared with a direct loaded calcium carbonate (adding calcium carbonate directly to the fiber suspension) at the same loading (filler) level. This yields an economic advantage in that the filler level of the paper is increased by replacing the more expensive fiber source (wood fibers) with calcium carbonate. The finished paper web has higher strength properties due to the increased filler levels of the calcium carbonate. In contrast, the strength properties of a finished web using direct loaded calcium carbonate is less.

For example, U.S. Pat. No. 5,223,090 (Klungness, et al.) discloses a method for chemically loading a fiber suspension with calcium carbonate. In one described method, calcium oxide or calcium hydroxide is placed within a refiner unit and carbon dioxide is injected into the refiner unit at a specified pressure. The fiber suspension is maintained within the refiner for a predetermined period of time to ensure that a proper chemical reaction and thus proper chemical loading of the fiber suspension occurs. In another described method, a fiber suspension with calcium oxide or calcium hydroxide is introduced into a 20 quart food mixer and carbon dioxide gas is injected into the mixer at a specified pressure. Using either the refiner or the food mixer, both methods utilize a batch processing method for processing only a small amount of the fiber suspension at a time. Because of the large amount of fiber suspension which is required at the wet end of a paper-making machine, a batch process requires that the chemically loaded fiber suspension be transferred to another holding tank for ultimate use in a paper-making machine.

What is needed in the art is an apparatus for chemically loading calcium carbonate in and on fibers in a fiber suspension for use in a paper-making machine, which provides an improved chemical reaction for optimal fiber loading.

SUMMARY OF THE INVENTION

The present invention provides a fiber loading apparatus which effectively loads fibers within a fiber suspension by injecting carbon dioxide before a rotor and stator in a reaction chamber.

The invention comprises, in one form thereof, an apparatus for loading fibers in a fiber suspension with calcium carbonate. The apparatus includes a housing with a fiber source inlet, and inlet chamber and an accept outlet. A stator is carried by the housing. A rotor is positioned in opposing relation with the stator. Each of the rotor and the stator are positioned downstream from the inlet chamber. A reactant gas supply is positioned in fluid communication with the inlet chamber.

An advantage of the present invention is that the reactant gas is thoroughly mixed with the fiber source and reactant solid mixture, thereby improving the chemical reaction within the reactor.

Another advantage is that the reactant gas is injected into the reactor in a manner which allows a more thorough chemical reaction, while at the same time all owing adaptation between different types of reactors, such as fluffers, dispergers and refiners.

Yet another advantage is that specific types of calcium carbonate crystals are grown on the fiber walls of the individual fibers, thereby providing different physical properties to the fiber web produced as an end product.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, which is a schematic illustration of an embodiment of a fiber loading apparatus of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown an embodiment of a fiber loading apparatus 10 of the present invention for loading fibers in a fiber suspension with calcium carbonate. Fiber loading apparatus 10 generally includes a reactor 12 and a reactant gas generator 14.

Reactant gas generator 14 generates a reactant gas which is injected into reactor 12 and used in the chemical reaction to form the calcium carbonate which is loaded into and on the fibers within reactor 12. Reactant gas generator 14 generates carbon dioxide and/or ozone which is injected into reactor 12. In the embodiment shown, reactant gas generator 14 is in the form of an apparatus carrying out a combustion process which generates carbon dioxide used within reactor 12. For example, reactant gas generator 14 may be in the form of an internal combustion engine used as a generator, mechanical drive, etc. during processing of the fiber suspension which produces carbon dioxide as a by-product of the combustion process carried out therein. The carbon dioxide is used as a reactant gas within reactor 12.

Reactor 12 generally includes a housing 16, stator 18 and rotor 20. In the embodiment shown, reactor 12 is in the form of a fluffer. However, reactor 12 may also be in the form of a disperger, refiner or other suitable equipment. Housing 16 includes a fiber source inlet 22, an inlet chamber 24 and an accept outlet 26. Inlet 22 receives a fiber source 28 from a feed device 29 to be loaded with calcium carbonate, and concurrently receives a reactant solid 30 used as a reactant in the chemical reaction to produce the calcium carbonate.

Fiber source 28 may include virgin and/or recycled fibers, with the individual fibers having a fiber wall surrounding a lumen. Reactant solid 30, in the embodiment shown, is in the form of calcium oxide and/or calcium hydroxide used in the chemical reaction within reactor 12. Reactant solid 30 is mixed with fiber suspension 28 to provide an initial desired process pH, e.g., between 11 and 12. In the embodiment shown, reactant solid 30 is in the form of lime which is mixed with fiber suspension 28 prior to introduction within inlet chamber 24.

Stator 18 is carried by housing 16 and positioned downstream or on the discharge side of inlet chamber 24. Stator 18, together with rotor 20, define a tackle within reactor 12. In the embodiment shown, stator 18 is in the form of a centrally open disk having a plurality of teeth facing towards rotor 20. However, stator 18 may be differently configured, depending upon the particular application.

Rotor 20 is positioned within housing 16 and in opposing relationship with stator 18. Each of rotor 20 and stator 18 are positioned downstream from inlet chamber 24, relative to a direction of flow of the fiber suspension through reactor 12. In the embodiment shown, rotor 20 is in the form of a disk which is driven by an external source of power (not shown) and rotates about a longitudinal axis 32 as indicated by directional arrow 34. In the embodiment shown, rotor 20 is configured as a disk having a plurality of teeth which face in an axial direction toward stator 18. Rotor 20 and/or stator 18 are movable toward and away from each other to adjust the gap therebetween, as indicated by double headed arrow 36.

A distribution foil 38 is positioned generally coaxially with rotor 20, and also rotates about longitudinal axis 32. Each of distribution foil 38 and rotor 20 may be carried by a common shaft (not shown). Distribution foil 38 functions to direct the fiber suspension into the gap between stator 18 and rotor 20, as indicated by flow arrows 40.

A plenum 42 is positioned within inlet chamber 24. Plenum 42 surrounds inlet chamber 24, and includes a plurality of openings (not numbered) which are in fluid communication with inlet chamber 24. Plenum 42 is fluidly coupled with and receives a reactant gas such as carbon dioxide and/or ozone from reactant gas generator 14. A controllable valve 44 controls the supply of reactant gas into plenum 42, and ultimately into inlet chamber 24.

Fiber source 28 is provided to reactor 12 from feed device 29. Feed device 29 may be, e.g., in the form of a plug screw or mixing screw providing the fiber source to inlet 22.

During use, fiber source 28 is transported into inlet 22 at a consistency of between about 2.5 and 25%, more preferably between about 20 and 25%. The reactant solid 30 is concurrently introduced at inlet 22 to inlet chamber 24 at a temperature of between about 5 and 95° C., and at a pressure of between about 0.5 and 150 pounds per square inch (psi). Reactant solid 30 is mixed with fiber source 28 such that reactant solid 30 is between about 5 and 60% of the total consistency of the mixture with fiber source 28. The reactant gas, preferably in the form of carbon dioxide, is injected into plenum 42 surrounding inlet chamber 24. Reactant gas flows through the plurality of openings in plenum 42 and into inlet chamber 24. The reactant gas is injected into inlet chamber 24 at a temperature of between about 5 and 95° C., and at a pressure of between about 5 and 150 psi. The carbon dioxide injected into inlet chamber 24 is heavier than air, and thus tends to settle via gravitational force to the bottom of inlet chamber 24. However, the mixing of the fiber suspension 28 and reactant solid 30 causes the carbon dioxide to be mixed therein and carried into the gap between stator 18 and rotor 20. Distribution foil 38 also assists in mixing the carbon dioxide into the fiber suspension and reactant solid mixture as it is conveyed into the gap between stator 18 and rotor 20. Various variables effecting the chemical reaction resulting in loading of calcium carbonate within the individual fibers in the fiber suspension include time, pressure, temperature, consistency, rotational speed of rotator 20, gap distance between stator 18 and rotor 20, lime content and/or purity within the reactant solid, pressure and temperature of the reactant gas, and consistency of the reactant gas which is injected into inlet chamber 24.

In the embodiment shown, reactant solid 30 is in the form of calcium hydroxide and reactant gas generator 14 provides a reactant gas in the form of carbon dioxide, as indicated above. Thus, the chemical reaction occurring within reactor 12 is represented by the chemical equation:

$$Ca(OH)_2+CO_2 \leftrightarrows CaCO_3+H_2O$$

The calcium carbonate thus produced by the chemical reaction is effectively loaded into the lumen and grown as crystals on the fiber walls of a substantial portion of the fibers within the fiber suspension by controlling the initial process pH, temperature, pressure, reaction time, lime slaking temperature and lime average particle size. Dependent upon the specific application for which the fiber suspension is to be utilized (e.g., paper, carton, cardboard, tissue, etc.) the different types of crystals which may be grown on and in the fiber walls as well as on the fiber surface and between fibers of the individual fibers provide different physical properties to the resultant end product in the form of a fiber web. By precisely monitoring and controlling the initial process pH, reaction temperature, reaction pressure, reaction time, lime slaking temperature and lime average particle size as indicated above, a specific type of calcium carbonate crystal is controllably grown on the fiber walls, thereby altering the physical properties of the resultant fiber web. For example, using the fiber loading apparatus such as shown in the drawing, rhombohedral, scalenohedral, aciculares aragonite and substantially spherical-shaped crystals can be formed on and in the fiber walls as well as on the fiber surface and between the individual fibers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of loading fibers in a fiber source with calcium carbonate, the fibers including a fiber wall surrounding a lumen, said method comprising the steps of:

providing a housing including a fiber source inlet, an inlet chamber and an accept outlet;

providing a stator carried by said housing, said stator having a central stator opening therein;

providing a rotor in opposing relation with said stator, each of said rotor and said stator positioned downstream from said inlet chamber;

providing a distribution foil generally coaxial and rotatable with said rotor;

introducing a reactant solid into said inlet chamber and through said central stator opening;

transporting the fiber into said inlet chamber and through said central stator opening;

directing said reactant solid and the fiber between said rotor and said stator using said distribution foil; and injecting a reactant gas into said inlet chamber.

2. The method of claim 1, including the step of growing a specific type of calcium carbonate crystals on the fiber walls of said fibers, said specific type of calcium carbonate crystals consisting of one of rhombohedral, scalenohedral, aciculares aragonite and substantially spherical-shaped crystals.

3. The method of claim 2, wherein said fiber source is transported into said inlet chamber at a consistency of between about 2.5 and 25%.

4. The method of claim 3, wherein said fiber source is transported into said inlet chamber at a consistency of between about 20 and 25%.

5. The method of claim 2, wherein said reactant solid is introduced into said inlet chamber at a temperature of between about 5 and 95° C., and at a pressure of between about 0.5 and 150 pounds per square inch.

6. The method of claim 2, wherein said reactant solid comprises between about 5 and 60% of the consistency of the fiber source.

7. The method of claim 2, wherein said reactant gas is injected into said inlet chamber at a temperature of between about 5 and 95° C., and at a pressure of between about 0.5 and 150 pounds per square inch.

8. The method of claim 1, wherein said injecting step comprises injecting a reactant gas consisting essentially of at least one of carbon dioxide and ozone.

9. The method of claim 1, wherein said reactant solid comprises at least one of calcium oxide and calcium hydroxide.

10. A method of loading fibers in a fiber source with calcium carbonate, the fibers including a fiber wall surrounding a lumen, said method comprising the steps of:

providing a housing including a fiber source inlet, an inlet chamber and an accept outlet, said housing including a plenum surrounding at least part of said inlet chamber, providing a stator carried by said housing;

providing a rotor in opposing relation with said stator, each of said rotor and said stator positioned downstream from said inlet chamber;

introducing a reactant solid into said inlet chamber;

transporting the fiber source into said inlet chamber; and injecting a reactant gas into said inlet chamber, said injecting step including injecting said reactant gas into said plenum.

11. The apparatus of claim 10, said injecting step including injecting said reactant gas through a plurality of openings in said plenum into said inlet chamber.

12. The apparatus of claim 11, said plenum being generally annular shaped around said inlet chamber.

* * * * *